US006064143A

United States Patent [19]

Kagawa

[11] Patent Number: 6,064,143

[45] **Date of Patent: *May 16, 2000**

[54] MULTIELECTRODE SPARK PLUG

[75] Inventor: Junichi Kagawa, Aichi, Japan

[73] Assignee: NGK Spark Plug Co., Ltd., Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/749,309

[22] Filed: Nov. 14, 1996

[30] Foreign Application Priority Data

| | | | |
|---|---|---|---|
| Nov. 15, 1995 | [JP] | Japan | 7-296484 |
| Oct. 30, 1996 | [JP] | Japan | 8-288733 |
| Nov. 11, 1996 | [JP] | Japan | 8-298390 |

[51] Int. Cl.[7] ..... F02M 57/06; F02P 13/00; H01T 13/00; H01T 13/20

[52] U.S. Cl. ..... 313/141; 313/118; 313/140; 123/169 EL

[58] Field of Search ..... 313/118, 141, 313/139, 140, 123, 127, 142, 143; 123/169 EL

[56] References Cited

U.S. PATENT DOCUMENTS

| | | | |
|---|---|---|---|
| 1,359,923 | 11/1920 | Savage | 313/141 |
| 1,381,167 | 6/1921 | De Clairmont | 313/123 |
| 1,548,556 | 8/1925 | Schmidt | 313/140 |
| 2,650,583 | 9/1953 | Devaux . | |
| 3,313,972 | 4/1967 | Beesch | 313/140 X |
| 3,870,918 | 3/1975 | Senda et al. | 313/131 R |
| 4,845,400 | 7/1989 | Takamura et al. | 313/142 |
| 5,448,130 | 9/1995 | Matsutani et al. | 313/141 |
| 5,497,045 | 3/1996 | Matsutani et al. | 313/141 |
| 5,581,145 | 12/1996 | Kato et al. | 313/141 |

FOREIGN PATENT DOCUMENTS

| | | | |
|---|---|---|---|
| 1446036 | 6/1966 | France . | |
| 2126686 | 10/1972 | France | H01T 13/00 |
| 51-95540 | 8/1976 | Japan . | |

*Primary Examiner*—Sandra O'Shea
*Assistant Examiner*—Mark Haynes
*Attorney, Agent, or Firm*—Finnegan, Henderson, Farabow, Garrett & Dunner, L.L.P.

[57] ABSTRACT

In order to provide a multielectrode spark plug which is excellent in resistance to fouling and in which the voltage required for producing a spark can be lowered, the tip portion of at least one of plural ground electrodes is positioned by the side of an annular front end face of an insulator to form a semi-creeping spark discharging gap elongating along the surface of the insulator with the tip portion of a center electrode, and the tip portions of the ground other electrodes form aerial spark discharging gaps with the tip portion of the center electrode.

13 Claims, 13 Drawing Sheets

MULTIELECTRODE SPARK PLUG

BACKGROUND OF THE INVENTION

1. Field of the Invention

The invention relates to a multielectrode spark plug which has improved resistance to fouling.

2. Description of the Related Art

A multielectrode spark plug is often used to reduce spark wear of a ground electrode and improve ignitability. A creeping spark plug or a semi-creeping spark plug is used to conduct burn-cleaning of conductive materials (mainly carbon caused by unburned fuel) deposited on the surface of the front end portion of an insulator and prevent fouling resistance from being impaired. As an example of such a spark plug, Japanese Patent Publication (Kokai) No. SHO51-95540 discloses a multigap spark plug having a plurality of ground electrodes 102, which are opposed to a center electrode 101, as shown in FIGS. 14A and 14B. The spark plug has two kinds of spark discharging gaps, namely, a semi-creeping spark discharge gap (creeping spark discharge gap 111+first aerial spark discharging gap 113), which is located partly along a tip end face of a front end portion of an insulator 104, and a second aerial spark discharging gap 112.

U.S. Pat. No. 2,650,583 discloses a spark plug 200 which, as shown in FIGS. 15A and 15B, has a plurality of layer-like ground electrodes 203 including electrodes 202, the tips of which oppose a center electrode 201, and has a plurality of spark discharging gaps formed between the center electrode 201 and the tips of the ground electrodes 203. The ground electrodes 203 of the spark plug 200 cover a part of a front face 205 of an insulator 204.

Furthermore, noble metal spark plugs which have noble metal fixed to a firing position of an electrode are popularly used to prevent spark wear, there by lengthening the life of the noble metal spark plug.

When a conventional spark plug 300 of the parallel electrode type, as shown in FIG. 16, is used in reversed polarity, a discharge voltage is raised. As a result, when smolder occurs, a discharge may not take place across the normal spark discharge gap. Specifically, when smolder occurs and the insulation resistance between a center electrode 301 and a ground electrode 302 is decreased, the output voltage of a power coil is divided by the output impedance of the power coil and the insulation resistance between the center electrode 301 and the ground electrode 302; hence, the voltage from the power coil, which appears across the normal spark discharge gap, is lowered. When smolder occurs and carbon is deposited, therefore, the discharge voltage at the normal spark discharge gap is raised and a discharge hardly takes place.

In the spark plug 100 disclosed in Japanese Patent Publication (Kokai) No. SHO51-95540 shown in FIGS. 14A and 14B, a spark discharge at the aerial spark discharge gap 112 occurs not largely far from a spark discharge by the creeping spark discharge gap (111+113). Specifically, when a spark discharge takes place across the creeping spark discharge gap, the spark is produced along the tip end face of the front end portion 106 of the insulator 104 and at the shortest distance between the front end portion 106 of the insulator 104 and the ground electrode 102. By contrast, when a spark discharge takes place across the second aerial spark discharge gap 112, the spark is produced at the shortest distance between the ground electrode 102 and the center electrode 101. The locations of the sparks in the air gaps differ substantially corresponding to the thickness of the ground electrode 102. Therefore, the location where a spark discharge takes place cannot be protruded from the front end of the spark plug and its ignitability cannot be sufficiently improved.

In the spark plug 200 of U.S. Pat. No. 2,650,583 shown in FIGS. 15A and 15B, a part of each ground electrode 203 partly covers the tip end face of the insulator 204. Therefore, it is impossible to conduct burn-cleaning of carbon deposited on the portions of the insulator 204 covered with the ground electrodes 203, and the ability of burning off carbon-adhering on the surface of the insulator 204 is decreased. When the distance between the front end portion of the insulator 204 and the ground electrodes 203 is short, a carbon bridge is easily produced, creating a high possibility of engine stall. When the distance between the front end portion of the insulator 204 and the ground electrodes 203 is long, a voltage required for producing a spark across the semi-creeping spark discharge gap is raised. Consequently, a spark takes place less likely along the front end portion of the insulator 204, and the cleaning ability of burning-off carbon deposited on the front end portion of the insulator 204 is lowered.

SUMMARY OF THE INVENTION

It is an object of the invention to provide a multielectrode spark plug in which, even if the plug is used in a reversed-polarity system, the voltage required for producing a spark can be lowered and the plug is excellent in fouling resistance.

A multielectrode spark plug according to the present invention comprises a metallic shell, an insulator having an axial bore, the insulator being fitted to the metallic shell such that a front end portion of the insulator is protruded from a tip of the metallic shell, a center electrode fitted to the axial bore such that a tip portion of the center electrode is protruded from the front end portion of the insulator, and a plurality of ground electrodes secured to the tip of the metallic shell, a tip portion of each of the ground electrodes being bent toward the center electrode to form a spark discharge gap with the tip portion of the center electrode. The plurality of ground electrodes include a semi-creeping spark discharge ground electrode, the tip portion of the semi-creeping spark discharge ground electrode being positioned by a side of the tip portion of the center electrode to form a semi-creeping spark discharging gap with a basal portion of the tip portion of the center electrode, a part of the semi-creeping spark discharging gap extending along a tip end face of the front end portion of the insulator; and an aerial spark discharge ground electrode forming an aerial spark discharging gap with a side face of the tip portion of the center electrode.

According to the present invention, the semi-creeping spark discharge ground electrodes are used for burn-cleaning of conductive materials (carbon caused by unburned fuel) deposited on the surface of the insulator. Therefore, high fouling resistance can be attained and smolder can be prevented. Since the aerial spark discharge ground electrode is disposed separately from the semi-creeping spark discharge ground electrode, ignitability can be ensured.

DETAILED DESCRIPTIONS OF THE INVENTION

Figure 1:
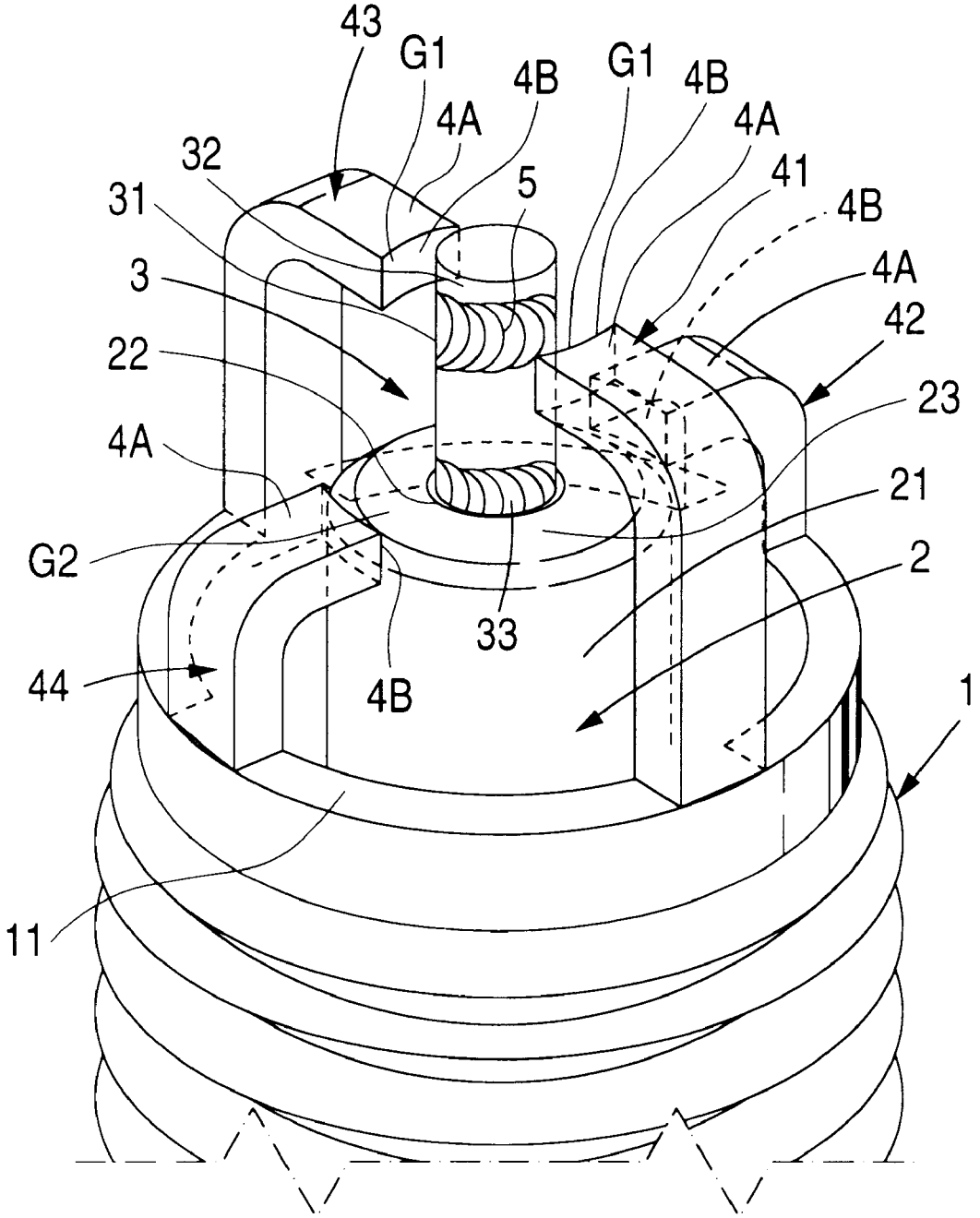
FIG. 1 is a perspective view showing a part of the multielectrode spark plug of a first embodiment according to the present invention.

Detailed descriptions of the present invention will be described as follows.

First, according to the present invention, in a multielectrode spark plug having a plurality of ground electrodes, at least one of the ground electrodes is a semi-creeping spark discharge ground electrode and remaining ground electrodes are an aerial spark discharge ground electrodes. The tip portion of the semi-creeping spark discharge ground electrode is positioned by a side of the tip portion of the center electrode to form a semi-creeping spark discharge gap with the basal portion of the tip portion of the center electrode, a part of the semi-creeping spark discharging gap extending along a tip end face of the front end portion of the insulator. The remaining ground electrodes are aerial spark discharge ground electrodes, and the tip portion of the aerial spark discharge ground electrode forms an aerial spark discharge gap with a side face of the tip portion of the center electrode.

Second, in the first configuration of the multielectrode spark plug, it is preferable that a first firing portion of the center electrode, where aerial spark discharging gap is formed between the aerial spark discharge ground electrode and the side face of the tip portion of the center electrode, is configured by fixing a noble metal, a noble metal alloy or a material containing a noble metal, such as platinum Pt, platinum-iridium Pt—Ir, platinum-nickel Pt—Ni, platinum-iridium-nickel Pt—Ir—Ni, platinum-rhodium Pt—Rh, or iridium-yttria Ir—$Y_2O_3$.

Third, in the second configuration of the multielectrode spark plug, it is preferable that the first firing portion is formed by an alloy layer obtained by melting and then solidifying the noble metal material or the noble metal alloy material and an electrode base material.

Fourth, in the first to third configurations of the multi-electrode spark plug, it is preferable that a second firing portion of the center electrode, where the semi-creeping spark discharging gap is formed between the semi-creeping spark discharge ground electrode and the basal portion of the tip portion of the center electrode, is configured by fixing a noble metal or a noble metal alloy, such as platinum Pt, platinum-iridium Pt—Ir, platinum-nickel Pt—Ni, platinum-iridium-nickel Pt—Ir—Ni, platinum-rhodium Pt—Rh or iridium-yttria Ir—$Y_2O_3$.

Fifth, in the fourth configuration of the multielectrode spark plug, the second firing portion is formed by an alloy layer obtained by melting and then solidifying the noble metal material or the noble metal alloy material and an electrode base material.

Sixth, in the first to fifth configurations of the multielectrode spark plug, it is preferable that a third firing portion of the aerial spark discharge ground electrode, where a aerial spark discharging gap is formed between the aerial spark discharge ground electrode and the side face of the tip portion of the center electrode, is configured by fixing a noble metal or a noble metal alloy, such as platinum Pt, platinum-iridium Pt—Ir, platinum-nickel Pt—Ni, platinum-iridium-nickel Pt—Ir—Ni, platinum-rhodium Pt—Rh or iridium-yttria Ir—$Y_2O_3$.

Seventh, in the sixth configuration of the multielectrode spark plug, it is preferable that the third firing portion is formed by an alloy layer obtained by melting and then solidifying the noble metal material, the noble metal alloy material or a material containing a noble metal and an electrode base material.

Eighth, in the first to seventh configurations of the multieletrode spark plug, a fourth firing portion of the semi-creeping spark discharge ground electrode, where a semi-creeping spark discharging gap is formed between the semi-creeping spark discharge ground electrode and the basal portion of the tip portion of the center electrode, is configured by fixing a noble metal or a noble metal alloy, such as platinum Pt, platinum-iridium Pt—Ir, platinum-nickel Pt—Ni, platinum-iridium-nickel, Pt—Ir—Ni, or platinum-rhodium Pt—Rh or iridium-yttria Ir—$Y_2O_3$.

Ninth, in the eighth configuration of the multielectrode spark plug, the fourth firing portion is formed by an alloy layer obtained by melting and then solidifying the noble metal material or the noble metal alloy material and an electrode base material.

Tenth, in the first to ninth configurations of the multielectrode spark plug, it is preferable that, where T is a thickness of the semi-creeping spark discharge ground electrode and + is an axial direction toward the tip portion of the center electrode from the tip of the metallic shell, A, which is a distance in an axial direction between a tip of the fourth firing portion of the semi-creeping spark discharge ground electrode and a tip of the front end portion of the insulator, is expressed by −1.5 mm≦A≦T+0.5 mm, and the aerial spark discharging gap G1, the semi-creeping spark discharging gap G2, and a shortest distance G3 between the fourth firing portion of the semi-creeping spark discharge ground electrode and the front end portion of the insulator satisfies a relation of G2>G1>G3.

Eleventh, in the tenth configurations of the multielectrode spark plug, it is preferable that the shortest distance G3 between the fourth firing portion of the semi-creeping spark discharge ground electrode and the front end portion of the insulator is 0.7 mm or less.

Twelfth, in the first to eleventh configurations of the multielectrode spark plug, the aerial spark discharge ground electrode and/or the semi-creeping spark discharge ground electrode consists of four electrodes which are disposed at equal intervals, two opposing electrodes of the four electrodes are the aerial spark discharge ground electrodes, and the other two opposing electrodes are the semi-creeping spark discharge ground electrodes.

In the first to tenth configurations, among the plural ground electrodes, the semi-creeping spark discharge ground electrodes are used for burn-cleaning of conductive materials (carbon caused by unburned fuel) deposited on the surface of the insulator. Therefore, high fouling resistance can be attained and smolder can be prevented. Since the aerial spark discharge ground electrode is disposed separately from the semi-creeping spark discharge ground electrode, it is possible to ensure ignitability when the fouling state is recovered.

In the second, fourth, sixth and eighth configurations, the use of a noble metal or a noble metal alloy which has a high melting point can reduce spark wear of the electrodes and has improved durability. For fixing such a noble metal or a noble metal alloy, for example, resistance welding or a laser beam to only the boundary between an electrode base material and a member of a noble metal or a noble metal alloy placed on the base material may be employed.

In the third, fifth, seventh and ninth configurations, since the firing portion is formed by an alloy layer obtained by melting and then solidifying a noble metal material or a noble metal alloy material and an electrode base material, the alloy layer can be firmly fixed and the durability can be enhanced. In order to realize this configuration, preferably, a member of a noble metal or a noble metal alloy is placed on an electrode base material. A part of the electrode base material is melted at the same time when the member of a noble metal, a noble metal alloy or a material containing a noble metal is completely melted by irradiation of a laser beam. This process mixes the member and the material and solidifies the molten.

In the tenth configuration, an aerial spark discharge and a semi-creeping spark discharge are adequately produced and ignitability and the function of burn-cleaning are optimized. The semi-creeping spark discharging gap G2 is larger than the aerial spark discharging gap G1. Therefore, when fouling materials, such as carbon, are not deposited on the front end portion of the insulator, a spark is easily produced across the aerial spark discharging gap G1. The aerial spark discharging gap G1 is larger than the shortest distance G3 between the fourth firing portion of the semi-creeping spark discharge ground electrode and the front end portion of the insulator. Therefore, when fouling materials, such as carbon, are deposited on the front end portion of the insulator, a spark is easily produced across the semi-creeping spark discharging gap G2.

On the other hand, as the tip of the firing portion of the semi-creeping spark discharge ground electrode is located nearer the tip of the metallic shell, the less burn-cleaning occurs because a spark is prevented from being produced across the semi-creeping spark discharging gap G2, until deposited carbon caused by unburned fuel reaches the basal portion of the front portion of the insulator and severe smoldering occurs.

In other words, when the tip of the firing portion of the semi-creeping spark discharge ground electrode is positioned at a higher position, a spark is produced across the semi-creeping spark discharging gap G2 even in an initial stage of carbon deposition (i.e., slight smolder); hence, the carbon is easily subjected to burn-cleaning.

Consequently, it is preferable to position the tip of the firing portion of the semi-creeping spark discharge ground electrode in such a manner that, when the axial direction away from the tip portion of the metallic shell is designated as+, the distance in an axial direction between the tip of the firing portion and that of the front end portion of the insulator is −1.5 mm or larger.

As the tip of the firing portion of the semi-creeping spark discharge ground electrode is positioned further away from the tip of the metallic shell than the tip of the front end portion of the insulator, the shortest distance G3 between the firing portion of the semi-creeping spark discharge ground electrode and the front end portion of the insulator becomes larger. As the distance G3 is made larger, the voltage required for a spark discharge becomes higher.

In the eleventh configuration, the voltage required for a spark discharge across the semi-creeping spark discharge gap can be prevented from being raised. When the shortest distance G3 between the firing portion of the semi-creeping spark discharge ground electrode and the front end portion of the insulator is larger than 0.7 mm, the insulator may be easily broken during the discharge machining (hereinafter, also referred to as channeling) of the front end portion of the insulator. Therefore, it is preferable to set the shortest distance G3 between the firing portion of the semi-creeping spark discharge ground electrode and the front end portion of the insulator to 0.7 mm or less. However, if the distance G3 of the aerial discharge of the semi-creeping spark discharge is too small to clean up carbon, ignition of the engine becomes difficult.

As the twelfth configuration, it is preferable to configure two opposing electrodes as the aerial spark discharge ground electrodes and other two opposing electrodes as the semi-creeping spark discharge ground electrode for improved durability and burn-cleaning.

Figure 6:
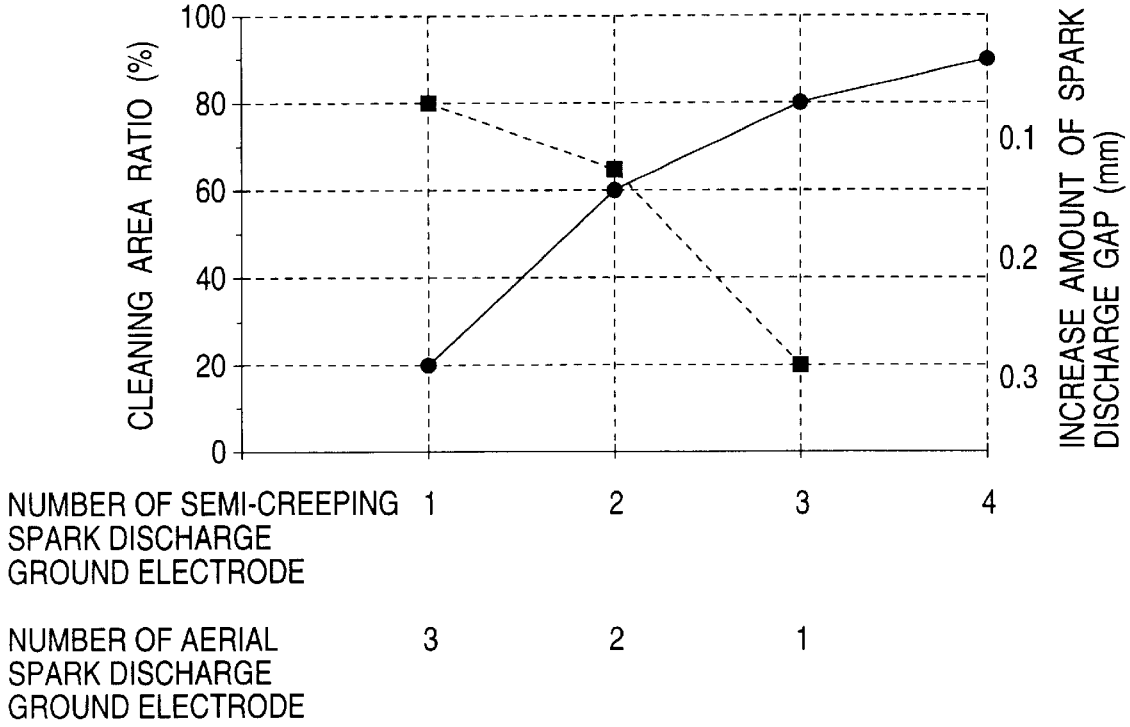
FIG. 6 is a diagram illustrating the relationship between the spark cleaning area rate and the increase in a spark discharge gap according to the invention having four ground electrodes.

As shown in FIG. 6, as the number of the semi-creeping spark discharge ground electrodes increases, the area where carbon caused by unburned fuel is removed away by a semi-creeping spark discharge widens and the number of the aerial spark discharge ground electrodes reduces. As a result, the occurrence rate of the aerial discharges in each electrode increases and the durability is impaired. In order to balance the burn-cleaning of unburned fuel and the durability of the ground electrodes, it is preferable to configure the ground electrodes by two aerial spark discharge ground electrodes and two semi-creeping spark discharge ground electrodes.

Figure 7:
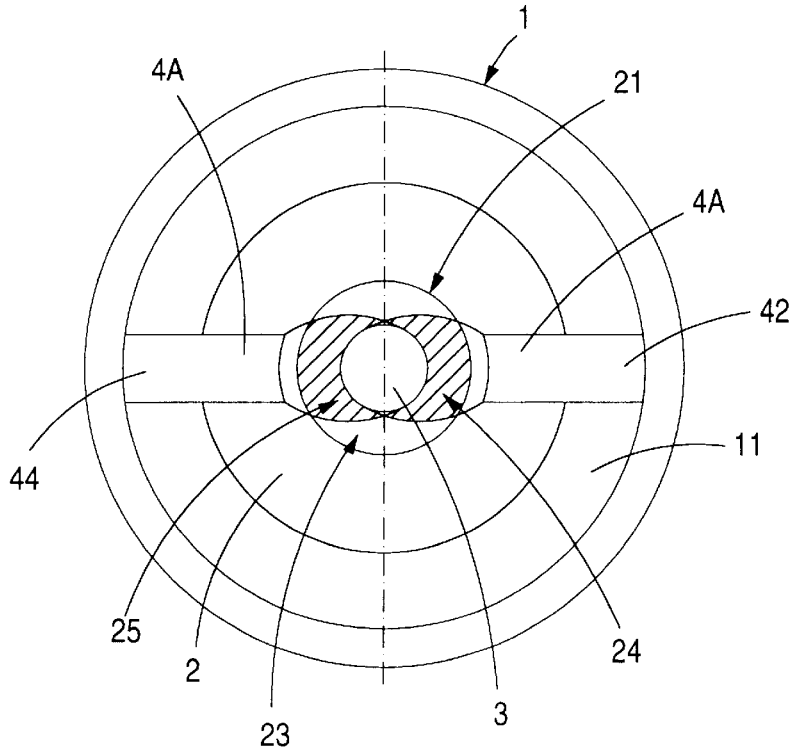
FIG. 7 is a diagram illustrating the burn-cleaning state according to the invention with two semi-creeping spark discharge ground electrodes.

On the other hand, FIG. 7 shows that, with respect to carbon caused by unburned fuel and deposited on the tip 23 of the front end portion 21 of the insulator 2, the total area of a burn-cleaning zone (1) 24 and a burn-cleaning zone (2) 25 due to spark discharges is widest when semi-creeping spark discharge ground electrodes 42 and 44 are opposed to each other. This is because, when the semi-creeping spark discharge ground electrodes 42 and 44 have a mutual positional relationship of 180°, the burn-cleaning zone (1) 24 and the burn-cleaning zone (2) 25 at the tip 23 of the front end portion 21 of the insulator 2 which is formed by the semi-creeping spark discharge ground electrode 42 and 44 respectively and the center electrode 3 overlap each other in a wide range.

Therefore, the configuration with two opposing semi-creeping spark discharge ground electrodes is most excellent in ignitability and fouling recovery property, and has high practicality.

Next, preferred embodiments according to the present invention will be described as follows referring to the accompanying drawings.

Figure 2:
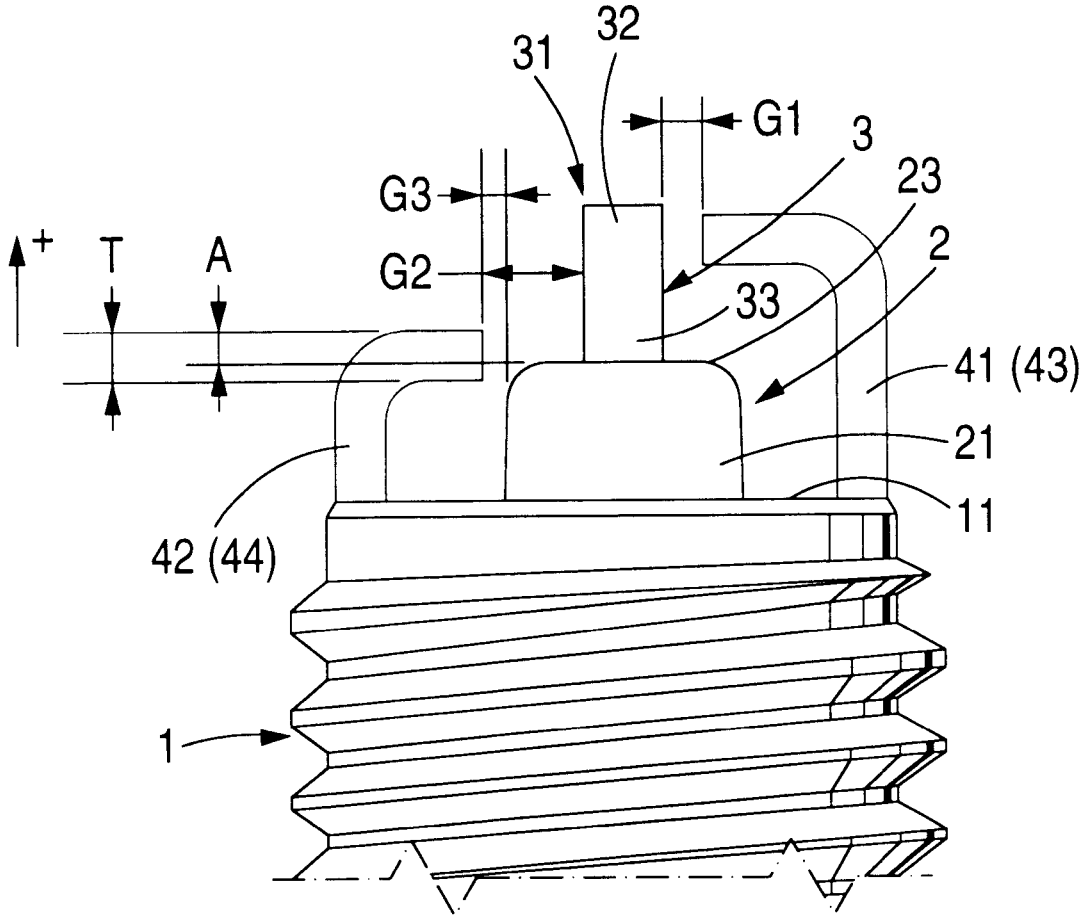
FIG. 2 is a side view illustrating a part of the multielectrode spark plug of the first embodiment.

FIGS. 1 and 2 show a multielectrode spark plug according to the present invention. The multielectrode spark plug includes a metallic shell 1, and an insulator 2 having an axial bore 22. The insulator 2 is fitted to the metallic shell 1 such that the front end portion of the insulator 2 is protruded from the tip 11 of the metallic shell 1. A center electrode 3 is fitted to the axial bore 22 of the insulator 2 such that the tip portion 31 of the center electrode 3 is protruded from the tip 23 of the front end portion 21 of the insulator 2.

Four ground electrodes 41 to 44 are welded at equal intervals to the tip 11 of the metallic shell 1. The tip portion 4A of each of the ground electrodes is bent toward the center electrode 3, and the front end face 4B and the tip portion 31 of the center electrode 3 forms a spark discharging gap. For the ground electrodes 41–44, two opposing electrodes are aerial spark discharge ground electrodes 41 and 43, which form aerial spark discharging gaps G1 with the side face of the end face 32 of the tip portion 31 of the center electrode 3.

The other two electrodes are positioned by the side of the front end portion 21 of the insulator 2 and configure semi-creeping spark discharge ground electrodes 42 and 44. The semi-creeping spark discharge ground electrodes 42 and 44 and the basal portion 33 of the tip portion 31 of the center electrode 3 form semi-creeping spark discharge gaps G2, each of which comprises a creeping face extending along the front end portion 21 of the insulator 2 and the shortest distance G3 between the front end portion 21 and the front end face 4B.

In the multielectrode spark plug shown in FIG. 1, the side face (firing portion) of the tip portion 31 of the center electrode 3, which forms the aerial spark discharging gaps G1, is configured by an alloy layer 5. The alloy layer 5 is obtained by melting and solidifying a noble metal, a noble metal alloy or a material containing a noble metal, such as platinum Pt, platinum-iridium Pt—Ir, platinum-nickel Pt—Ni platinum-iridium-nickel Pt—Ir—Ni, platinum-rhodium Pt—Rh or iridium-yttrium Ir—$Y_2O_3$. Preferably, the noble metal to be used is platinum Pt.

Specifically, a laser beam is applied to melt the noble metal or the noble metal alloy and an electrode base material. Then the molten materials are solidified and forms the alloy layer 5. This configuration reduces spark wear of the firing portion of the center electrode and increases the life of the spark plug.

Figure 3:
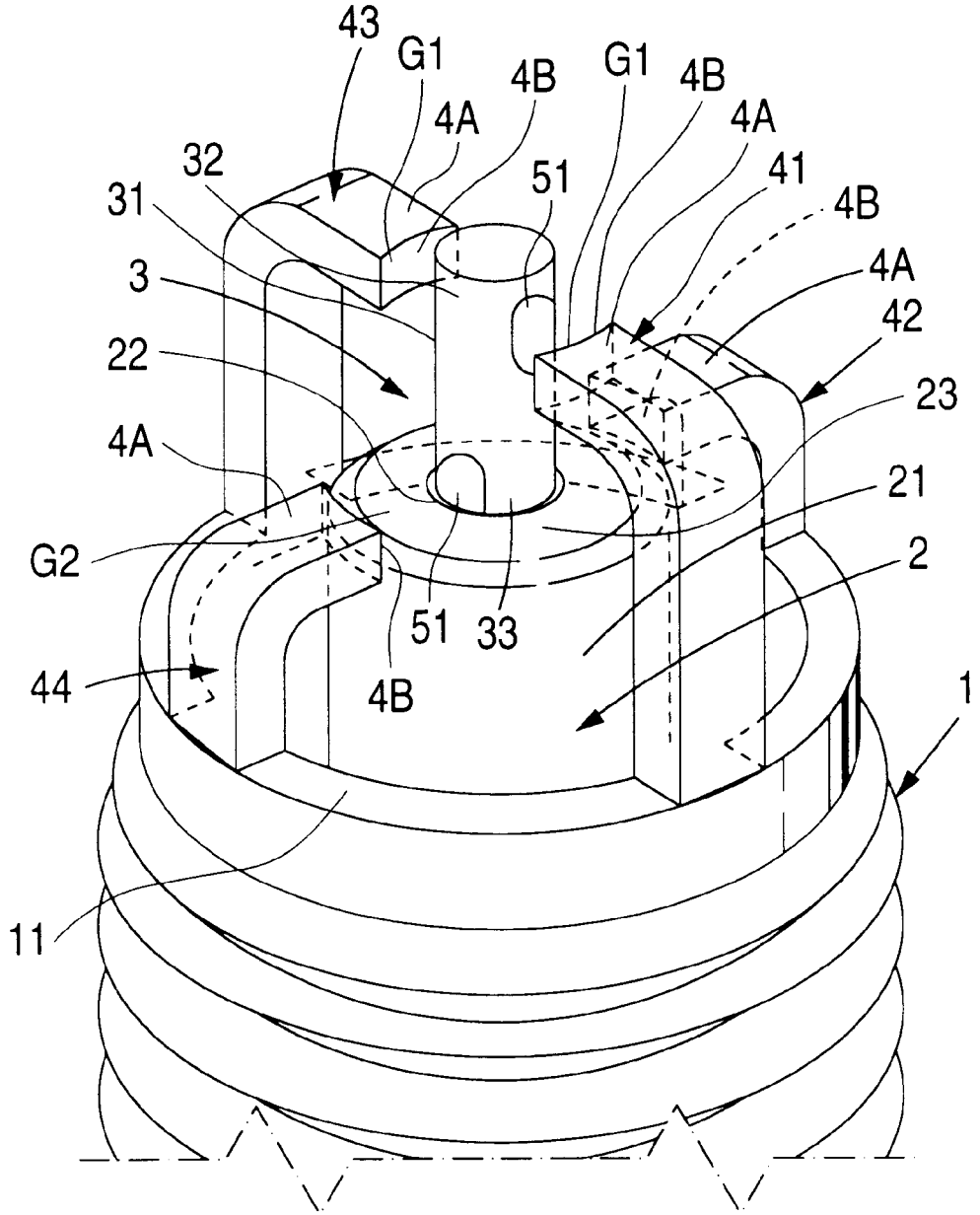
FIG. 3 is a perspective view showing a part of a multi-electrode spark plug of a second embodiment according to the present invention.

As shown in FIG. 3, the firing portion of the tip portion 31 of the center electrode 3 may be configured by resistance-welding a noble metal 51, such as platinum Pt, platinum-iridium Pt—Ir, platinum-nickel Pt—Ni, platinum-iridium-nickel Pt—Ir—Ni platinum-rhodium Pt—Rh or iridium-yttrium Ir—$Y_2O_3$. Alternatively, the firing portion may be configured by forming the noble metal 51 partly or only in the side faces of the center electrode 3 which face the aerial spark discharge ground electrodes 41 and 43. Preferably, platinum Pt is used as the noble metal 51.

Hereinafter, the function of the spark plug will be described. The spark plug is attached to an internal combustion engine, such as a gasoline engine, by a threaded portion formed on the metallic shell 1 such that the center electrode 3 and the ground electrodes 41 to 44 are located in a combustion chambers and used as a source for igniting a fuel-air mixture supplied to the combustion chamber. When the engine is operated intermittently or continuously for a long period under a light load condition, materials, such as carbon, are deposited on the front end portion of the insulator of the spark plug. The deposition of a conductive material, such as carbon, on the insulator 2 lowers the surface electrical resistance of the insulator. When the discharge voltage of the semi-creeping spark discharging gap G2 becomes higher than that of the aerial spark discharging gap G1, a spark takes place across the semi-creeping spark discharging gap G2 and carbon deposition caused by unburned fuel is burned off.

Figure 4:
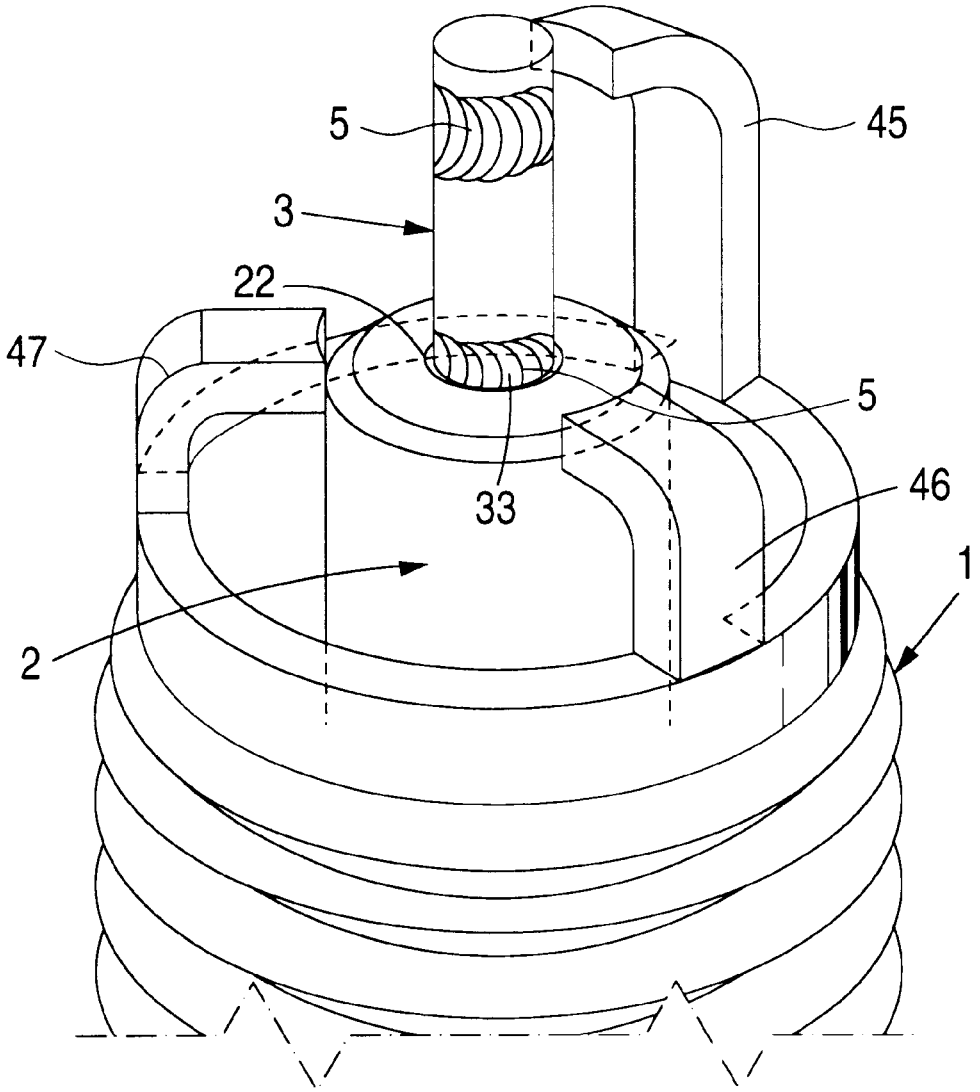
FIG. 4 is a perspective view showing a part of a multi-electrode spark plug of a third embodiment according to the present invention.

Alternatively, as shown in FIG. 4, a three-electrode spark plug may be configured in which one electrode is an aerial spark discharge ground electrode 45, which forms an aerial spark discharge gap with the outer periphery of the tip of the center electrode 3, and the other two electrodes are semi-creeping spark discharge ground electrodes 46 and 47. The ground electrodes are disposed at equal intervals of about 120°. A part of the firing face of each semi-creeping spark discharge ground electrode is positioned over the front end face of the tip portion of the insulator. The firing portion of the center electrode 3, which forms semi-creeping spark discharge gaps with the semi-creeping spark discharge ground electrodes 46 and 47, may be configured by welding a noble metal or a noble metal alloy, such as platinum Pt, platinum-iridium Pt—Ir, platinum-nickel Pt—Ni, platinum-iridium-nickel Pt—Ir—Ni, or platinum-rhodium Pt—Rh by a laser beam and then melting and solidifying it to form an alloy layer 5.

Also the outer periphery of the tip portion of the center electrode 3 is subjected to the laser-beam welding, melting and solidification, to form another alloy layer 5. The alloy layers 5 reduces spark wear of the respective firing faces and increases the life of the spark plug, as well as improving ignitability by lowering the quenching action.

Figure 5:
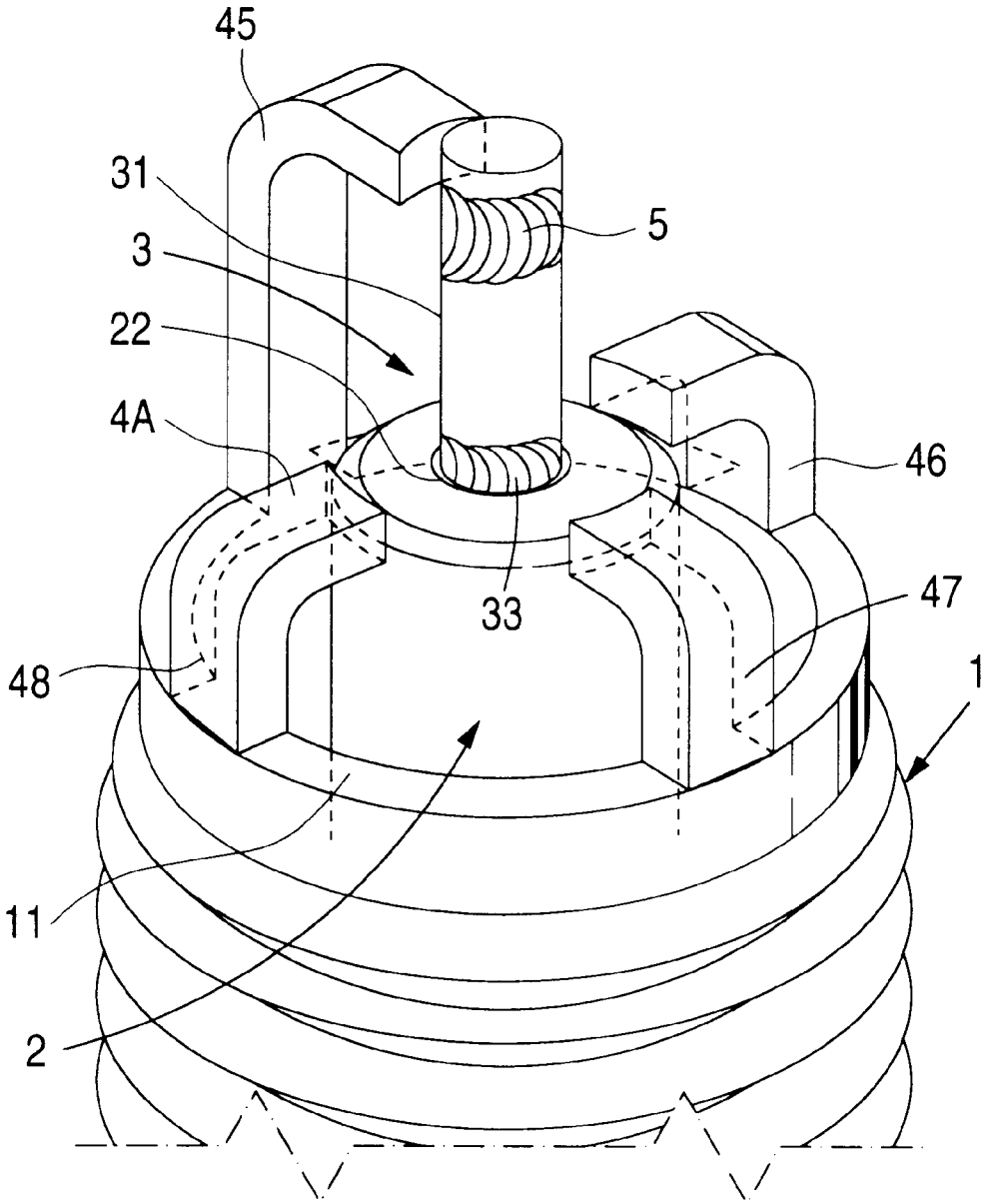
FIG. 5 is a perspective view showing a part of a multi-electrode spark plug of a fourth embodiment according to the present invention.

Alternatively, as shown in FIG. 5, a four-electrode spark plug may be configured such that one electrode is an aerial spark discharge ground electrode 45, which forms an aerial spark discharge gap with the outer periphery of the tip of the center electrode 3, and the other three electrodes are semi-creeping spark discharge ground electrodes 46, 47, and 48. The ground electrodes are disposed at equal intervals of about 90°.

EXAMPLES

As an Example (1) of the present invention, the spark plug having four ground electrodes, as shown in FIG. 1, was produced. The distance of the aerial spark discharging gaps G1 was set at 1.0 mm, and the distance of the shortest distance G3 between the semi-creeping spark discharge ground electrodes and the front end portion of the insulator was set at 0.7 mm. The diameter of the front end of the insulator was set at 4.7 mm, and the thickness T of the semi-creeping spark discharge ground electrodes was set to at 1.6 mm, and a distance A, a distance in an axial direction between the tips of the firing portions of the semi-creeping spark discharge ground electrodes and the tip of the front end portion of the insulator, was set at 0.5 mm.

Figure 12:
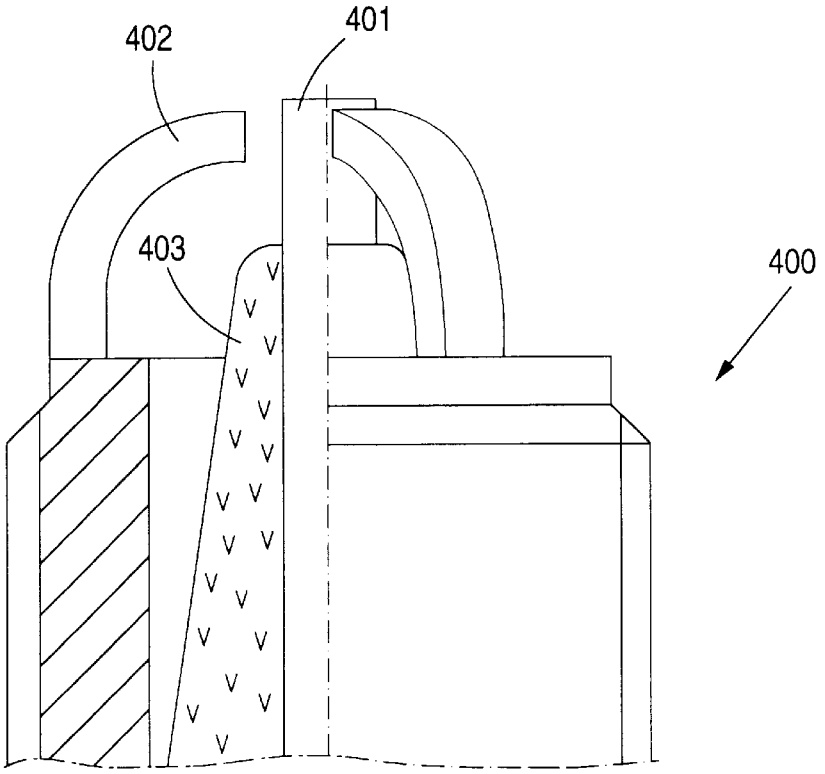
FIG. 12 is a diagram showing a part of a spark plug as a comparative example.
Figure 13:
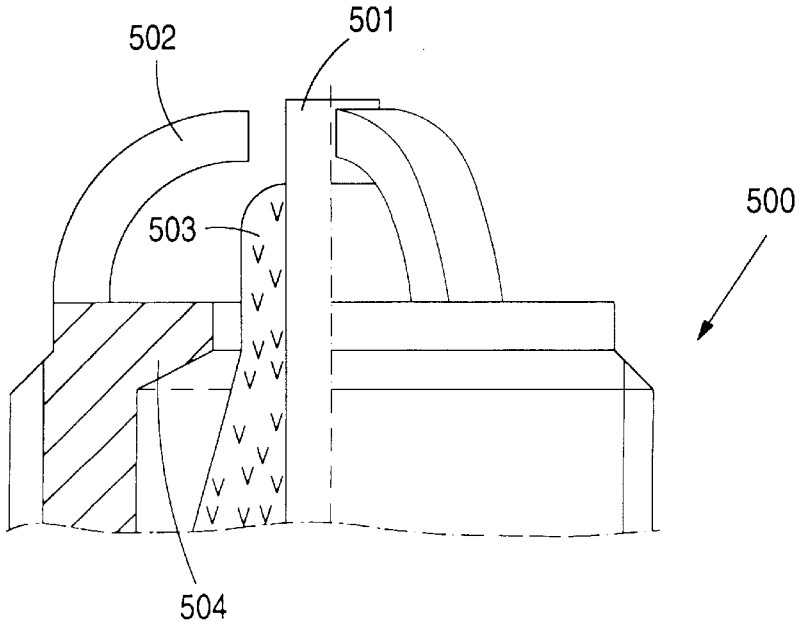
FIG. 13 is a diagram showing a part of a spark plug as another comparative example.
Figure 14A:
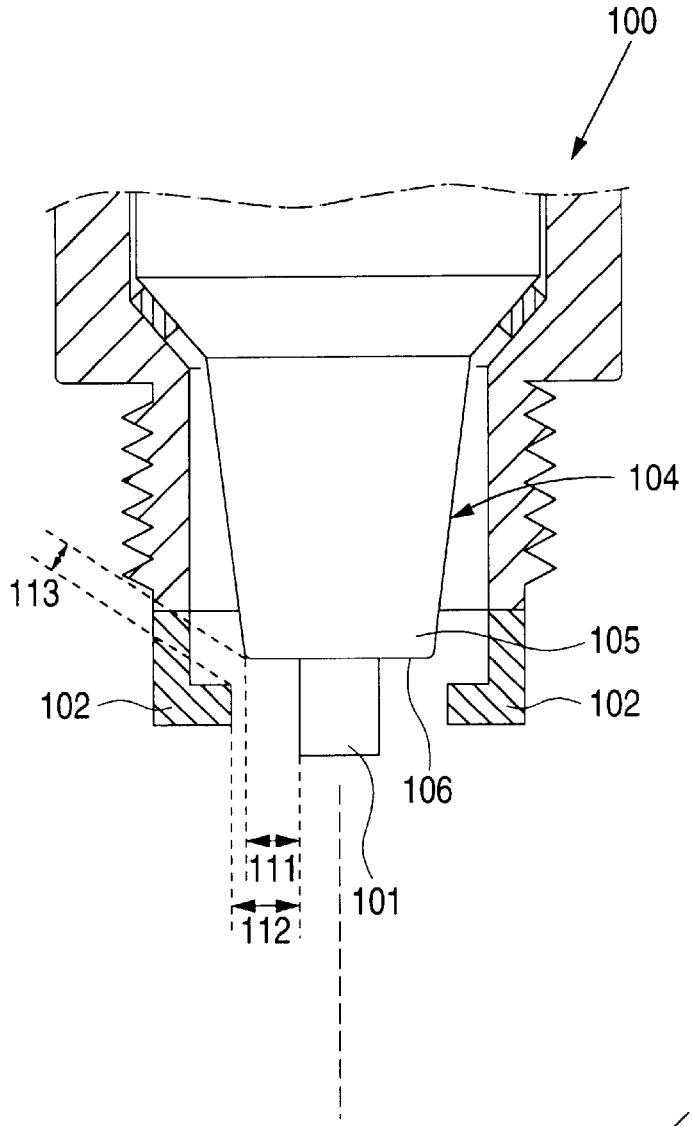
FIG. 14A PRIOR ART
FIG. 14A is a section view of a part of a conventional spark plug.
Figure 14B:
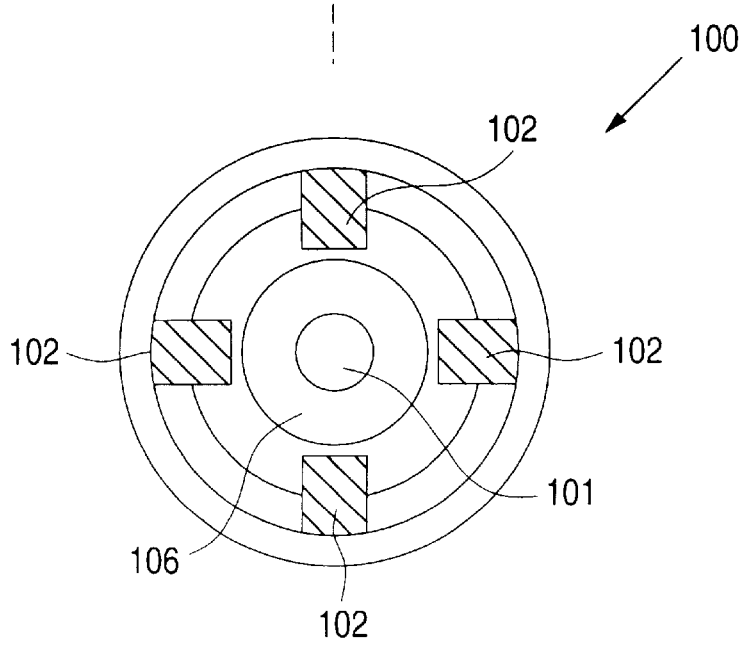
FIG. 14B PRIOR ART
FIG. 14B is a plan view of the conventional spark plug shown in FIG. 14A.
Figure 15A:
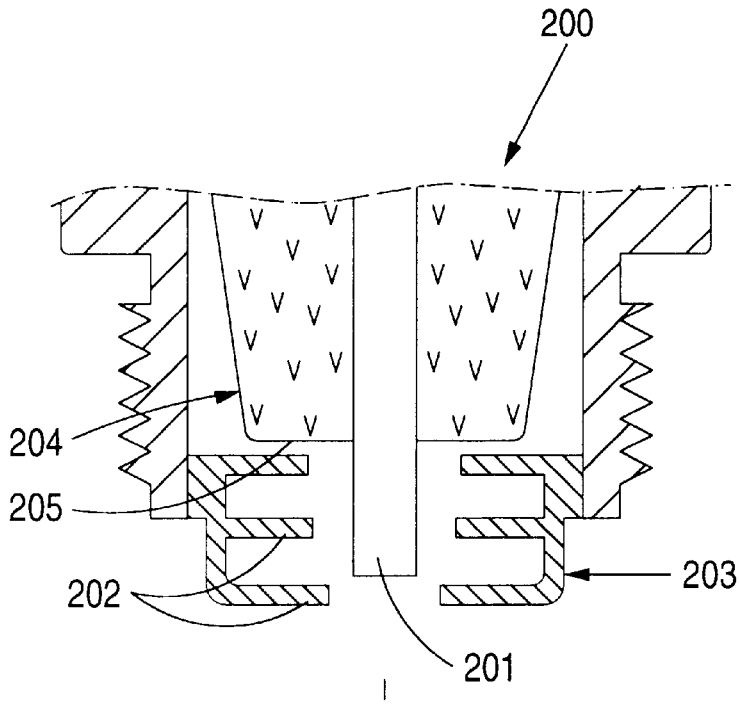
FIG. 15A PRIOR ART
FIG. 15A is a section view of a part of another conventional spark plug.
Figure 15B:
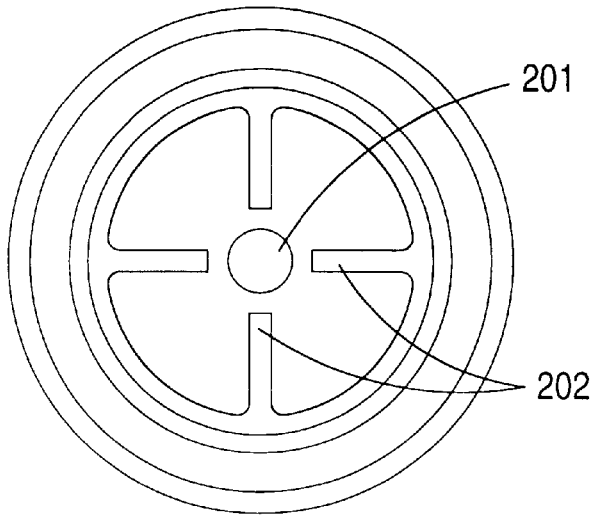
FIG. 15B PRIOR ART
FIG. 15B is a plan view of the conventional spark plug shown in FIG. 15A.
Figure 16:
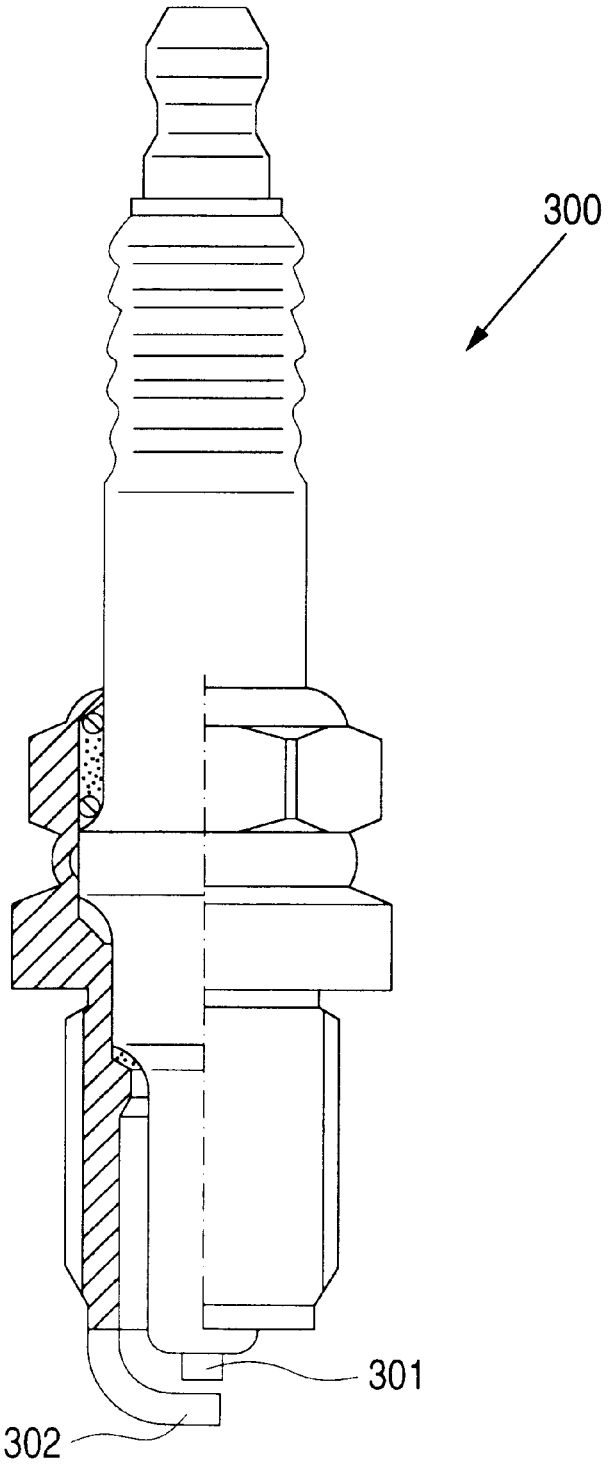
FIG. 16 PRIOR ART
FIG. 16 is a diagram showing a part of another conventional spark plug.

For a comparison purpose, examples of the spark plugs are also produced. A spark plug 400, as a comparative example (2), having three ground electrodes 402 (see FIG. 12) was produced such that the distance of the spark discharging gaps between a center electrode 401 and each of ground electrodes 402 was set at 1.0 mm and the diameter of the front end of the insulator 403 was set at 4.7 mm. The thickness T of the ground electrodes 402 was set 1.6 mm, and a distance A, a distance in an axial direction between the tips of the firing portions of the ground electrodes 402 and the tip of the front end portion of the insulator 403, was set at 3.8 mm. A spark plug 500, as a comparative example (3), having three ground electrodes (see FIG. 13) was produced so that the distance of the spark discharging gaps between a center electrode 501 and each of ground electrodes 502 was set at 1.0 mm and the diameter of the front end of the insulator 503 was set at 4.7 mm. The thickness T of the ground electrodes 502 was set at 1.6 mm, and the shortest distance between an auxiliary electrode 504 formed by bending the tip of the front end of the insulator 503 was set at 0.5 mm. A distance A, a distance in an axial direction between the tips of the firing portions of the ground electrodes 502 and the tip of the front end portion of the insulator 503, was set at 1.5 mm.

Figure 8:
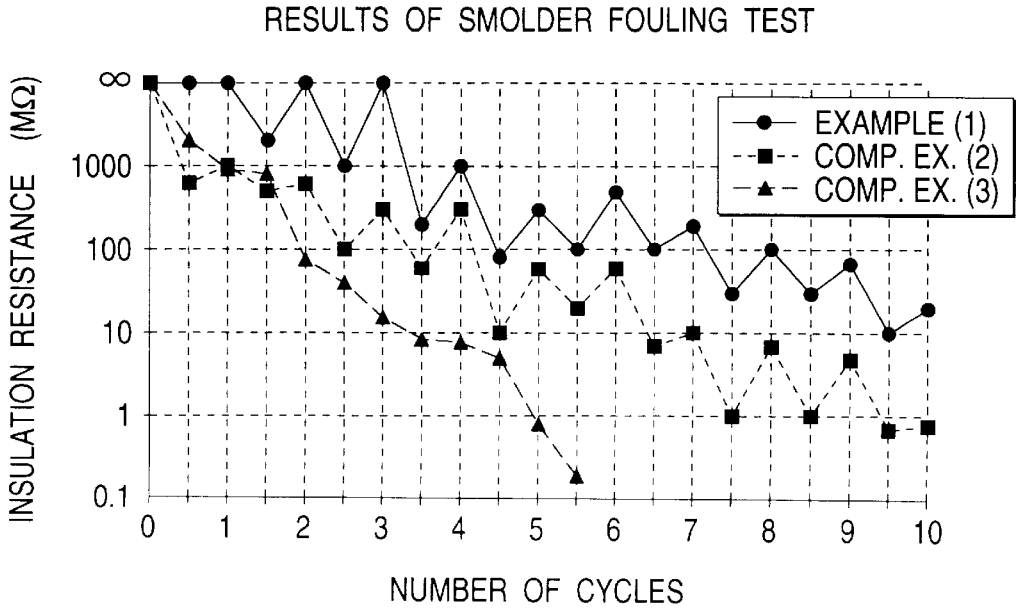
FIG. 8 is a diagram illustrating results of smolder fouling tests of spark plugs for an example of the invention.
Figure 9:
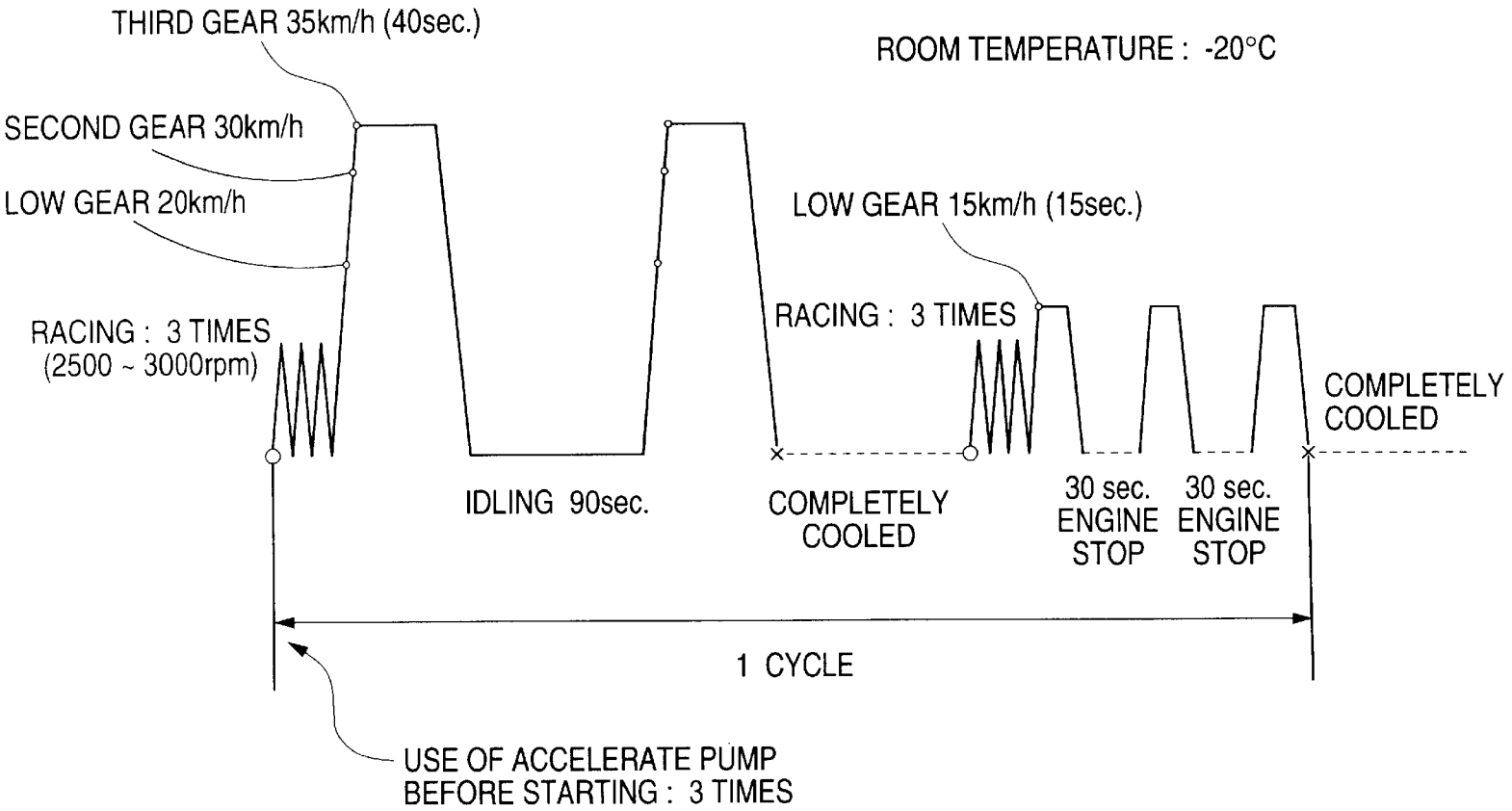
FIG. 9 is a diagram illustrating the running pattern in the smolder fouling tests in the example of the invention.

These spark plugs are mounted on a test car and smolder fouling tests were conducted under the performing the running pattern (according to JIS D1606), shown in FIG. 9, as one cycle. FIG. 8 shows results of the tests. It is apparent that, as compared with the spark plugs of the comparative examples, the spark plugs according to the present invention are superior in the insulation resistance and fouling resistance.

Figure 10:
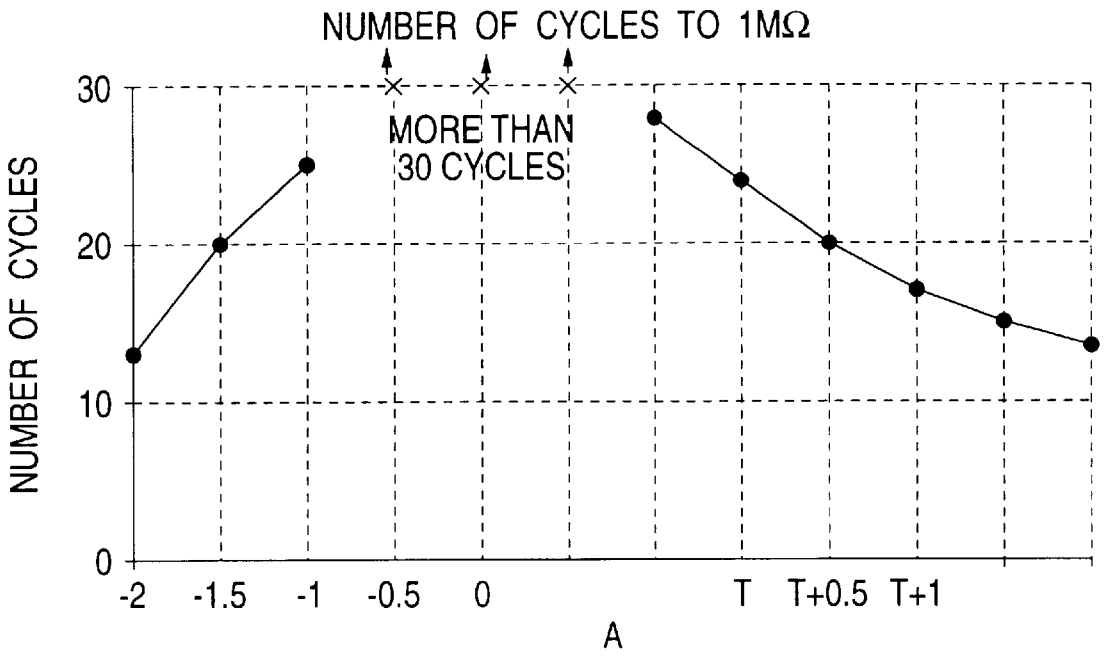
FIG. 10 is a diagram illustrating results of the smolder tests of spark plugs for the example of the invention.
Figure 11:
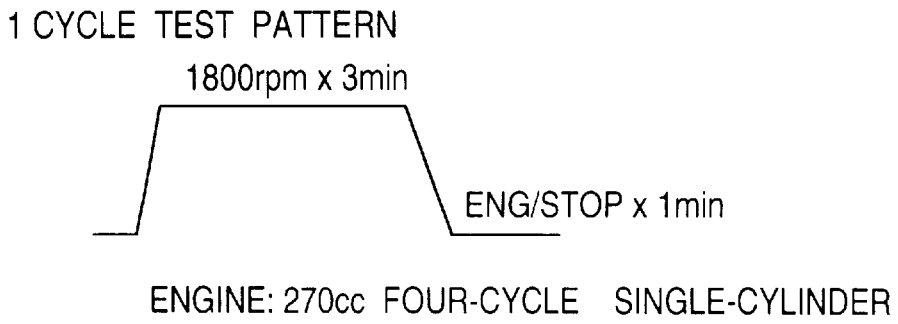
FIG. 11 is a diagram illustrating the running pattern in the smolder tests in the example of the invention.

Spark plugs, as shown in FIG. 1, having four ground electrodes were produced such that the distance of the aerial spark discharging gaps G1 was set at 1.0 mm, and the shortest distance G3 between the semi-creeping spark discharge ground electrodes and the front end portion of the insulator was set at 0.5 mm. The diameter of the front end of the insulator was set at 4.7 mm, and the thickness T of the semi-creeping spark discharge ground electrodes was set at 1.6 mm. The distance A in an axial direction between the tips of the firing portions of the semi-creeping spark discharge ground electrodes and the tip of the front end portion of the insulator was variously changed. These spark plugs were subjected to smolder tests with using a four-cycle single-cylinder engine of 270 cc, and their performance were evaluated. In the smolder tests, one cycle consists of 1,800 rpm×3 minutes and engine stop×1 minute (see FIG. 11). FIG. 10 shows results of the tests. It is apparent that, when the distance A is within the range of $-1.5\ \text{mm} \leqq A \leqq T+0.5$ mm, the insulation resistance of 1 MΩ or higher can be attained in 20 cycles or more and burn-cleaning can be efficiently conducted.

What is claimed is:

1. A multielectrode spark plug comprising:

a metallic shell;

an insulator having an axial bore, said insulator being fitted to said metallic shell such that a front end portion of said insulator is protruded from a tip of said metallic shell;

a center electrode fitted to said axial bore such that a tip portion of said center electrode is protruded from said front end portion of said insulator; and a plurality of ground electrodes secured to said tip of said metallic shell, a tip portion of each of said ground electrodes being bent toward said center electrode to form a spark discharge gap with said tip portion of said center electrode, said plurality of ground electrodes including:

a semi-creeping spark discharge ground electrode, said tip portion of said semi-creeping spark discharge ground electrode being positioned by a side of said tip portion of said center electrode to form a semi-creeping spark discharging gap with a basal portion of said tip portion of said center electrode, a part of said semi-creeping spark discharging gap extending along a tip end face of said front end portion of said insulator; and an aerial spark discharge ground electrode forming an aerial spark discharging gap with a side face of said tip portion of said center electrode, said aerial spark discharge ground electrode extending from said tip of said metallic shell farther than said semi-creeping spark discharge ground electrode, said aerial spark discharging gap being narrower than said semi-creeping spark discharging gap.

2. A multielectrode spark plug according to claim 1, wherein said center electrode includes a first firing portion for forming said aerial spark discharging gap between said aerial spark discharge ground electrode and said side face of said tip portion of said center electrode, said first firing portion is comprised of a noble metal, a noble metal alloy or a material containing a noble metal.

3. A multielectrode spark plug according to claim 2, wherein said first firing portion is formed by an alloy layer which is obtained by melting and then solidifying the noble metal material, the noble metal alloy material or the material containing a noble metal and an electrode base material.

4. A multielectrode spark plug according to claim 1, wherein said center electrode includes a second firing portion for forming said semi-creeping spark discharging gap between said semi-creeping spark discharge ground electrode and said basal portion of said tip portion of said center electrode, said second firing portion is comprised of a noble metal, a noble metal alloy or a material containing a noble metal.

5. A multielectrode spark plug according to claim 4, wherein said second firing portion is formed by an alloy layer which is obtained by melting and then solidifying the noble metal material, the noble metal alloy material or the material containing a noble metal and an electrode base material.

6. A multielectrode spark plug according to claim 1, wherein said aerial spark discharge ground electrode includes a third firing portion for forming an aerial spark discharging gap between said aerial spark discharge ground electrode and said side face of said tip portion of said center electrode, said third firing portion is comprised of a noble metal, a noble metal alloy or a material containing a noble metal.

7. A multielectrode spark plug according to claim 6, wherein said third firing portion is formed by an alloy layer which is obtained by melting and then solidifying the noble metal material, the noble metal alloy material or the material containing a noble metal and an electrode base material.

8. A multielectrode spark plug according to claim 1, wherein said semi-creeping spark discharge ground electrode includes a fourth firing portion for forming a semi-creeping spark discharging gap between said semi-creeping spark discharge ground electrode and said basal portion of said tip portion of said center electrode, said fourth firing portion is comprised of a noble metal, a noble metal alloy or a material containing a noble metal.

9. A multielectrode spark plug according to claim 8, wherein said fourth firing portion is formed by an alloy layer which is obtained by melting and then solidifying the noble metal material, the noble metal alloy material or the material containing a noble metal and an electrode base material.

10. A multielectrode spark plug according to claim 8, wherein, where T is a thickness of said semi-creeping spark discharge ground electrode and + is an axial direction toward said tip portion of said center electrode from said tip of said metallic shell, A, a distance in an axial direction between a tip of said fourth firing portion of said semi-creeping spark discharge ground electrode and a tip of said front end portion of said insulator, is expressed by $-1.5\ \text{mm} \leqq A \leqq T+0.5\ \text{mm}$, and said aerial spark discharging gap G1, said semi-creeping spark discharging gap G2, and a shortest distance G3 between said fourth firing portion of said semi-creeping spark discharge ground electrode and said front end portion of said insulator satisfies a relation of G2>G1>G3.

11. A multielectrode spark plug according to claim 10, wherein said shortest distance G3 between said fourth firing portion of said semi-creeping spark discharge ground electrode and said front end portion of said insulator is $G3 \leqq 0.7$ mm.

12. A multielectrode spark plug according to claim 1, wherein said plurality of ground electrodes are disposed at intervals of equal angles.

13. A multielectrode spark plug according to any one of claims 1 to 12, comprising four ground electrodes which are disposed at intervals of equal angles, wherein two opposing electrodes of said four ground electrodes are said aerial spark discharge ground electrodes, and the other two opposing electrodes are said semi-creeping spark discharge ground electrodes.

* * * * *